US006052872A

United States Patent [19]

Lang et al.

[11] Patent Number: 6,052,872

[45] Date of Patent: Apr. 25, 2000

[54] APPARATUS FOR CONDENSING A DRAFTED FIBER STRAND

[75] Inventors: Kurt Lang, Lauterstein; Fritz Stahlecker, Josef-Neidhart-Strasse 18, 73337, Bad Uberkingen, both of Germany

[73] Assignees: Fritz Stahlecker, Bad Ueberkingen; Hans Stahlecker, Suessen, both of Germany

[21] Appl. No.: 09/360,993

[22] Filed: Jul. 27, 1999

[30] Foreign Application Priority Data

Aug. 17, 1998 [DE] Germany ..... 198 37 180

[51] Int. Cl.[7] ..... D01H 5/72

[52] U.S. Cl. ..... 19/288; 19/236; 19/246

[58] Field of Search ..... 19/150, 236, 237, 19/238, 239, 240, 241, 242, 243, 244, 245, 246, 247, 248, 249, 250, 252, 263, 286, 287, 288, 304, 305, 306, 307, 308; 57/328, 333

[56] References Cited

U.S. PATENT DOCUMENTS 5,090,192 2/1992 Stahlecker ..... 57/333
5,243,813 9/1993 Stahlecker ..... 57/333

FOREIGN PATENT DOCUMENTS 2-40767 9/1990 Japan .

*Primary Examiner*—John J. Calvert
*Assistant Examiner*—Gary L. Welch
*Attorney, Agent, or Firm*—Evenson, McKeown, Edwards & Lenahan, P.L.L.C.

[57] ABSTRACT

A draft free condensing zone for condensing a drafted fiber strand is provided between a front roller pair of a drafting unit of a ring spinning machine and a delivery roller pair arranged downstream thereof. The apparatus for condensing comprises an air-permeable und suctioned sliding surface which is in contact with the fiber strand, under which sliding surface is located a suction slit which is stationarily arranged and extends essentially in transport direction of the fiber strand. The sliding surface is the front surface of a rotating disc, whose rotational axle extends essentially perpendicular to the transport direction of the fiber strand.

29 Claims, 1 Drawing Sheet

APPARATUS FOR CONDENSING A DRAFTED FIBER STRAND

BACKGROUND AND SUMMARY OF THE INVENTION

This application claims the priority of German application 198 37 180.2,filed in Germany on Aug. 17, 1998, the disclosure of which is expressly incorporated by reference herein.

The present invention relates to an apparatus for condensing a drafted fiber strand in a condensing zone between the front roller pair of a drafting unit and a delivery roller pair, which apparatus includes an air permeable and suctioned sliding surface, which is movable and in contact with the fiber strand, under which sliding surface a suction slit, stationarily arranged and extending essentially in transport direction of the fiber strand, is located.

An apparatus of this type is described in the Japanese published patent 2-40767. Between the front roller pair of the drafting unit and a delivery roller pair arranged downstream thereof, the drafted fiber strand runs in this apparatus through a draft-free section, in which the fiber strand is in contact with a suction roller rotating transversely to the transport direction of the fiber strand. The suction roller imparts a certain false twist to the fiber strand and thus condenses the fiber strand. As in the condensing zone the fiber strand is already drafted to the desired fineness, but is not yet strengthened by means of a twist, a movement of the sliding surface transversely to the transport direction of the fiber strand leads very quickly to an end break.

It is an object of the present invention to improve the above mentioned apparatus in that instead of a transversely extending suction roller, a sliding surface is provided which does not lead to end breaks.

This object has been achieved in accordance with the present invention in that the sliding surface is the front surface of a rotating disk, whose rotational axle extends essentially perpendicular to the transport direction of the fiber strand.

By means of embodiments according to the present invention, the sliding surface itself imparts to the fiber strand in the condensing zone a motion component in transport direction, without deviating the fiber strand too far from its original direction of motion. The transport direction is determined practically by means of the form of the suction slit, while the sliding surface itself contributes mechanically thereto that the fiber strand can follow the direction of the suction slit also. The drafted, still untwisted fiber strand is hereby pneumatically condensed in that edge fibers are rolled in around the core strand. By means of this condensing, the fiber strand receives a better substance utilization, which leads to a greater evenness and a higher tensile strength of the yarn to be spun and simultaneously to a reduced hairiness.

The diameter of the disc should correspond approximately to the distance of the nipping lines between the front roller pair and the delivery roller pair. The disc should extend deep into the wedge-shaped gaps of the above mentioned two roller pairs and hereby have almost contact to the roller pairs. This is then achieved when the disc has approximately a diameter of 25 mm in the case of the spinning of cotton. This embodiment of the present invention results in the advantage that the rolled-in fiber ends do not roll back out again.

The suction slit should also extend as far as possible into the nipping line of the delivery roller pair. This supports the above mentioned measures effectively.

The width of the suction slit is wider than the width of the drafted fiber strand. This applies in particular there where the fiber strand is already condensed. When the fiber strand runs into the condensing zone, it is possible that it is wider than the suction slit; it is, however, important that as a result of the larger width of the suction slit, air can flow past both sides of the fiber strand. Only then is a pneumatic condensing possible by means of pneumatic transverse forces. The pneumatic condensing is supported by the false twist which the disk, by means of its rotation, imparts to the fiber strand.

At least in the area of the axle of rotation of the disk it is provided that the suction slit extends approximately parallel to the periphery of the disc. This results in a boomerang-shaped suction slit, which at first moves somewhat laterally transversely away from the entrance to the condensing zone and then is guided back after a small deflection. This embodiment according to the present invention permits the current transport direction of the fiber strand to follow approximately the peripheral direction of motion of the disc. The fiber strand to be condensed obtains thus almost in the entire condensing zone a component of motion in the transport direction despite its lateral deflection. End breaks in the condensing area can thus be effectively avoided.

The disk is provided /with a plurality of holes, whose diameter measures between 0.5 mm and 0.8 mm, according to the thickness of the disc. These relatively large diameters of the holes result in the advantage that the holes are not covered by fiber fly during suction.

It is favorable when the peripheral speed of the disk in the area of the suction slit is significantly greater than the transporting speed of the fiber strand. Speeds of approximately 400 to 500 rpm are preferred. Hereby, the rotating disc, so to speak, slides away from under the fiber strand, whereby the rolling-in of the edge fibers is additionally supported.

The condensing effect is improved when the sliding surface, according to the material of the fibers to be spun, is provided with a suitable plating, for example with a nickel-diamond plating. Tests should establish which plating is most suited to the purpose. The plating does not primarily serve wear protection, but rather serves first and foremost the improvement of the spinning quality.

In an advantageous embodiment of the present invention, the disc is applied to the rotational axle in such a way that it can be easily removed, for example by means of a magnet holding device. The disc can be easily removed for cleaning without disassembly of further parts, or the disc can be exchanged for one suitable to the fiber material to be spun, for example when another plating or another hole size has to be applied.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
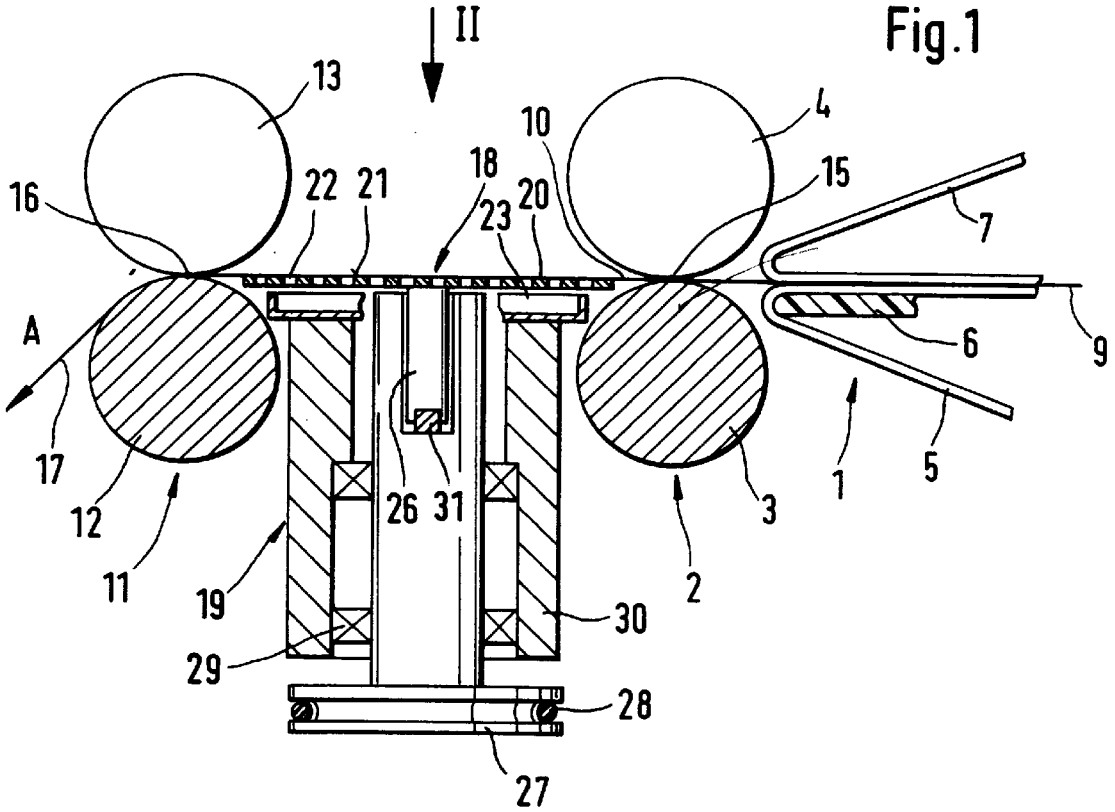
FIG. 1 is a partly sectional side view of the area of a condensing zone of a ring spinning machine, constructed according to a preferred embodiment of the present invention.
Figure 2:
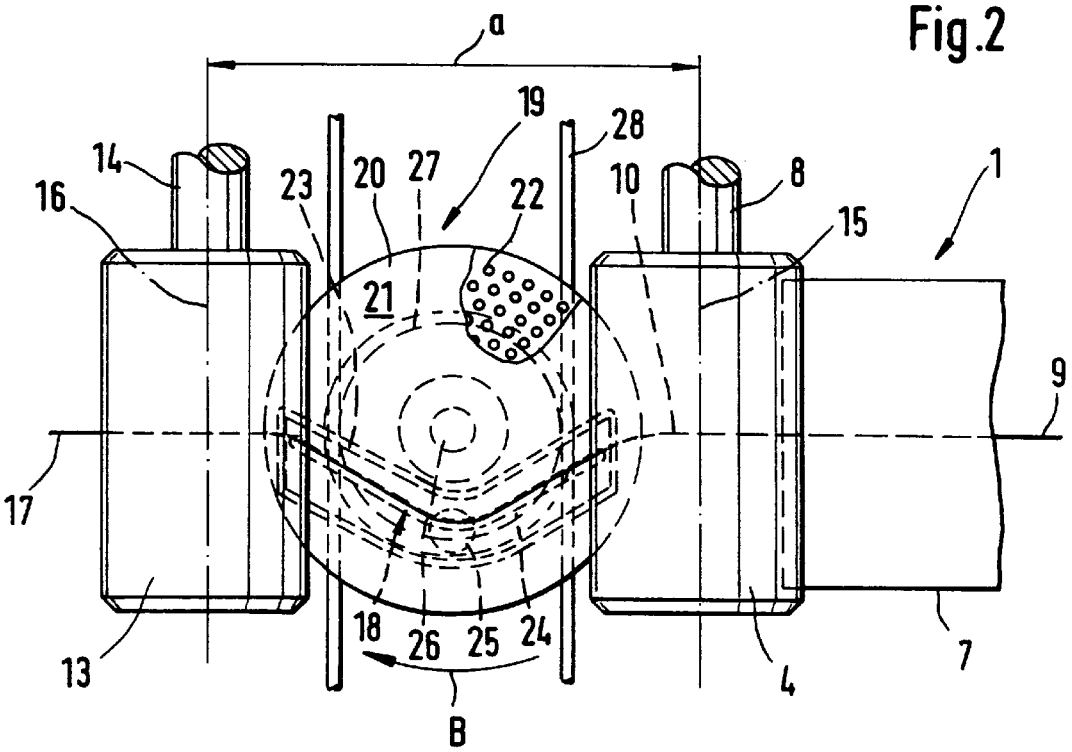
FIG. 2 is a view in the direction of the arrow II of FIG. 1.

Only the exit area of a drafting unit 1 is shown of the ring spinning machine according to FIGS. 1 and 2. The front roller pair 2 of the drafting unit 1 with a driven bottom cylinder 3 as well as a relevant top roller 4 can be seen. A bottom apron 5 as well as an upper apron 7 are arranged adjacent to the front roller pair 2. The bottom apron 5 is guided by a guide table 6. The top roller 4 is, in a way not shown, put together with an adjacent top roller to form a top roller twin, and in FIG. 2 the axle 8 between the top roller 4 and the adjacent top roller of another spinning station can be seen.

In the drafting unit 1, a sliver or roving 9 is drafted to the desired fineness in a known way. Downstream of the front roller pair 2 a drafted fiber strand 10 exists, in which at first no spinning twist has been introduced.

A delivery roller pair 11 is arranged downstream of front roller pair 2, the speed of said delivery roller pair 11 is such that the drafted fiber strand 10, apart from a very slight tension draft, is imparted no further draft. The delivery roller pair 11 consists also of a driven bottom cylinder 12 as well as top roller 13 arranged thereto. The axle 14 can be see again in FIG. 2, which connects the top roller 13 with an adjacent top roller (not shown).

Between the nipping line 15 of the front roller pair 2 and the nipping line 16 of the delivery roller pair 11 there is a distance "a", which is somewhat larger than the staple length of the fiber material to be spun. The nipping line 16 of the delivery roller pair 11 acts as a twist blocker for the spinning twist to be applied to the thread 17. Downstream of the delivery roller pair 11, the thread 17 is delivered in transport direction A to a ring spindle.

The so-called condensing zone 18 is located between the front roller pair 2 and the delivery roller pair 11, in which condensing zone 18 no further drafting takes place. The already drafted fiber strand 10 is to be further condensed in the condensing zone 18, before it is imparted a spinning twist, in that edge fibers are rolled in around the core strand. The thread 17 to be spun is then less hairy, the substance utilization is higher, and the thread 17 is smoother and more tear resistant.

The apparatus 19 arranged at the condensing zone 18 for condensing comprises a rotating disc 20, whose peripheral speed is significantly higher than the transport speed of the fiber strand 10. The diameter is so chosen that the disc 20 extends as far as possible to the nipping lines 15 and 16. The upper plane front surface is a sliding surface 21 for the fiber strand 10. The rotational direction B is so chosen that the fiber strand 10, guided away from its centrical position by the rotating disc 20, receives a motion component in transport direction A. The sliding surface 21 is advantageously provided with a suitable plating, which in addition to wear resistance, also improves the spinning quality.

The disc 20 is designed as air permeable and has holes 22 whose diameter measures advantageously between 0.5 and 0.8 mm. A stationarily arranged suction device 23 is located beneath the rotating disc 20, which suction device 23 comprises a suction slit 24, which extends essentially in transport direction. The width of the suction slit 24 is somewhat larger than the width of the drafted fiber strand 10. The length of the suction slit 24 is so chosen that it reaches as far as possible to the nipping lines 15 and 16. As can be seen in FIG. 2, the suction slit 24 is advantageously boomerang-shaped, that is, it extends to a large extent parallel to the periphery of the disc 20.

The suction slit 24 is provided with a vacuum connection 25 on its side facing away from the sliding surface 21. The vacuum level is only so high as to permit the desired condensing to take place.

The rotating disc 20 comprises a rotational axle 26, which extends essentially perpendicular to the fiber strand 10 as well as to the axles of the delivery roller pair 11. The sliding surface 21 of the disc 20 is located roughly in the drafting plane, that is the plane through which the tangents extend between the nipping lines 15 and 16.

The rotational axle 26 is connected to a drive disc 27, which is driven by a drive belt 28. The drive belt 28 extends over a plurality of spinning stations and drives a plurality of discs 20 simultaneously.

The rotational axle 26 is supported in a bearing housing 30 by means of bearings 29. The bearing housing 30 itself is connected to a vacuum source in a way not shown.

The disc 20 itself is placed by means of a peg, which is a part of the rotational axle 26, in an extension of the rotational axle. A holding magnet 31 serves as a coupling. The disc 20 can thus be easily removed upwards from the apparatus 19 for the purposes of cleaning or exchange when the top rollers 4 and 13 are raised in a known way from their bottom cylinders 3 and 12.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for condensing a drafted fiber strand in a condensing zone between a front roller pair of a drafting unit and a delivery roller pair, which apparatus includes an air permeable and suctioned sliding surface, which is movable and in contact with the fiber strand, under which sliding surface a suction slit, stationarily arranged and extending essentially in transport direction of the fiber strand, is located, wherein the sliding surface is a front and end face surface of a rotating disc, whose rotational axle extends essentially perpendicular to the transport direction of the fiber strand wherein the diameter of the disc corresponds approximately to the distance of the nipping lines between the front roller pair and delivery roller pair.

2. An apparatus according to claim 1, wherein the suction slit extends as far as is possible to the nipping line of the delivery roller pair.

3. An apparatus according to claim 2, wherein the width of the suction slit is larger than the width of the drafted fiber strand.

4. An apparatus according to claim 2, wherein the suction slit extends approximately perpendicular to the periphery of the disc, at least in the area of the rotational axle.

5. An apparatus according to claim 2, wherein the disc is provided with a plurality of holes with respective diameters measuring between 0.5 mm and 0.8 mm.

6. An apparatus according to claim 2, wherein the peripheral speed of the disc in the area of the suction slit is significantly greater than the transport speed of the fiber strand.

7. An apparatus according to claim 2, wherein the sliding surface is plated.

8. An apparatus according to claim 2, wherein the disc is applied to the rotational axle in such a way that it is easily removed.

9. An apparatus according to claim 1, wherein the suction slit extends as far as is possible to the nipping line of the delivery roller pair.

10. An apparatus according to claim 1, wherein the width of the suction slit is larger than the width of the drafted fiber strand.

11. An apparatus according to claim 10, wherein the suction slit extends approximately perpendicular to the periphery of the disc, at least in the area of the rotational axle.

12. An apparatus according to claim 10, wherein the disc is provided with a plurality of holes with respective diameters measuring between 0.5 mm and 0.8 mm.

13. An apparatus according to claim 1, wherein the width of the suction slit is larger than the width of the drafted fiber strand.

14. An apparatus according to claim 1, wherein the suction slit extends approximately perpendicular to the periphery of the disc, at least in the area of the rotational axle.

15. An apparatus according to claim 14, wherein the disc is provided with a plurality of holes with respective diameters measuring between 0.5 mm and 0.8 mm.

16. An apparatus according to claim 1, wherein the suction slit extends approximately perpendicular to the periphery of the disc, at least in the area of the rotational axle.

17. An apparatus according to claim 1, wherein the disc is provided with a plurality of holes with respective diameters measuring between 0.5 mm and 0.8 mm.

18. An apparatus according to claim 17, wherein the peripheral speed of the disc in the area of the suction slit is significantly greater than the transport speed of the fiber strand.

19. An apparatus according to claim 1, wherein the disc is provided with a plurality of holes with respective diameters measuring between 0.5 mm and 0.8 mm.

20. An apparatus according to claim 1, wherein the peripheral speed of the disc in the area of the suction slit is significantly greater than the transport speed of the fiber strand.

21. An apparatus according to claim 1, wherein the peripheral speed of the disc in the area of the suction slit is significantly greater than the transport speed of the fiber strand.

22. An apparatus according to claim 1, wherein the sliding surface is plated.

23. An apparatus according to claim 1, wherein the sliding surface is plated.

24. An apparatus according to claim 1, wherein the disc is applied to the rotational axle in such a way that it is easily removed.

25. An apparatus according to claim 1, wherein the disc is applied to the rotational axle in such a way that it is easily removed.

26. A condenser arrangement according to claim 25, wherein said disk is supported in use at a rotatable axle extending essentially perpendicular to a transport direction of the fiber strand between the nipping points.

27. A condenser arrangement according to claim 26, wherein the disk is a flat disk which extends in use to closely adjacent said nipping points.

28. A condenser arrangement according to claim 27, wherein said disk is detachably connected with the axle.

29. A condenser arrangement for condensing a fiber strand in a condensing zone moving between first and second nipping locations, comprising:

a rotatable perforated disk having an end face which in use forms a sliding surface which contacts the fiber strand between the nipping points, and a suction device operable to apply suction to the disk by way of a suction slit facing an opposite end face of the disk wherein said suction means extends in essentially a transport direction of the fiber strand so as to continuously condense said strand as it travels over the sliding surface.

* * * * *